US008690089B1

(12) United States Patent
Ganser, IV et al.

(10) Patent No.: US 8,690,089 B1
(45) Date of Patent: Apr. 8, 2014

(54) LATCH ASSEMBLY FOR ACCESS DOOR TO ROTATING DRUM

(75) Inventors: William Abraham Ganser, IV, Eugene, OR (US); Bradley Simon Harness, Springfield, OR (US)

(73) Assignee: Astec Industries, Inc., Chattanooga, TN (US)

( * ) Notice: Subject to any disclaimer, the term of this patent is extended or adjusted under 35 U.S.C. 154(b) by 388 days.

(21) Appl. No.: 13/317,607

(22) Filed: Oct. 24, 2011

Related U.S. Application Data

(60) Provisional application No. 61/406,889, filed on Oct. 26, 2010.

(51) Int. Cl.
*B02C 7/06* (2006.01)

(52) U.S. Cl.
USPC ..... 241/37.5; 241/285.3

(58) Field of Classification Search
USPC ..... 241/37.5, 285.1–285.3, 179, 299
See application file for complete search history.

(56) References Cited

U.S. PATENT DOCUMENTS

| | | | | |
|---|---|---|---|---|
| 4,212,574 | A * | 7/1980 | Dreier | 414/502 |
| 4,319,146 | A * | 3/1982 | Wires, Sr. | 307/328 |
| 4,718,199 | A * | 1/1988 | Harper, Jr. | 451/329 |
| 5,758,573 | A * | 6/1998 | Keeler et al. | 100/49 |
| 7,767,142 | B1 * | 8/2010 | Smith et al. | 422/37 |
| 2003/0122004 | A1 * | 7/2003 | Allen et al. | 241/24.29 |

* cited by examiner

*Primary Examiner* — Faye Francis
(74) *Attorney, Agent, or Firm* — Chambliss, Bahner & Stophel, P.C.

(57) ABSTRACT

A drum rotation machine includes a working drum mounted for rotation within an enclosure. An access door provides access to the interior of the enclosure, and the access door is moveable between a closed position and an open position. A latch assembly is mounted on the enclosure and is moveable between a locked position and an unlocked position. In the locked position, the latch assembly prevents the access door from moving from the closed position to the open position. In the unlocked position, the latch assembly allows the access door to be moved from the closed position to the open position, and engages an anti-rotation catch on the working drum to prevent rotation of the working drum.

15 Claims, 10 Drawing Sheets

LATCH ASSEMBLY FOR ACCESS DOOR TO ROTATING DRUM

CROSS-REFERENCE TO RELATED APPLICATION

This application claims the benefit of U.S. Provisional Patent Application No. 61/406,889, which was filed on Oct. 26, 2010.

FIELD OF THE INVENTION

The present invention relates to a drum rotation machine having a working drum mounted for rotation within a housing, which machine includes a door that provides access to the working drum. In a preferred embodiment of the invention, the drum rotation machine comprises a wood chipper.

BACKGROUND OF THE INVENTION

Wood chippers are commonly used for reducing large pieces of wood into smaller pieces. Some wood chippers are drum-type wood chippers having a rotating working drum equipped with blades or knives. In these types of wood chippers, the working drum may rotate at thousands of revolutions per minute to chop up and/or shred the wood. In this type of wood chipper, the working drum is generally located within an enclosure. Since there are times when access to the working drum within the enclosure is necessary for maintenance or repair, or in the event of failure of the chipper, it is common for wood chippers and similar devices to include an access door that permits access to the interior of the enclosure.

It is known to provide electronic components for drum-type wood chippers that are designed to sense the rotation of the working drum and to block the access door from opening while the working drum is rotating. While these electronic components may be suitable in many instances, various drawbacks may exist. For example, electronic components may be sensitive to heat and moisture extremes that may be characteristic of the environment in which such wood chippers are generally used. In addition, wood chippers may encounter or cause vigorous vibrations which may also cause electronic controls to fail or to operate unreliably.

ADVANTAGES OF THE INVENTION

Among the advantages of the present invention is that it provides a mechanical latch assembly that is configured to reduce the risk of an operator's being allowed to open the access door to the enclosure of a drum rotation machine while the working drum is rotating. Such mechanical latch assembly may be employed on machines with or without electronic controls.

Other advantages and features of this invention will become apparent from an examination of the drawings and the ensuing description.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

The use of any and all examples or exemplary language (e.g., "such as") herein is intended merely to better illuminate the invention and not to place a limitation on the scope of the invention, unless otherwise indicated by the claims. Nothing in the specification should be construed as indicating any non-claimed element as essential to the practice of the invention.

Various terms are specifically defined herein. These terms are to be given their broadest possible construction consistent with such definitions, as follows:

As used herein, the term "working drum" refers to a drum with one or more knives, blades, cutters, hammers or other working tools mounted thereon.

As used herein, the term "drum rotation machine" refers to a machine which includes an enclosure and a working drum that is mounted for rotation within the enclosure.

As used herein, the term "elongate bar" refers to a component of suitable length for the intended function, and of any suitable cross-section. An "elongate bar" need not be flat-sided.

SUMMARY OF THE INVENTION

The invention comprises a drum rotation machine having an enclosure and an access door that provides access to the interior of the enclosure. The access door is moveable between a closed position and an open position. A working drum having an anti-rotation catch thereon is mounted for rotation within the enclosure. A latch assembly is mounted on the enclosure and is moveable between a locked position and an unlocked position. In the locked position, the latch assembly prevents the access door from moving from the closed position to the open position. In the unlocked position, the latch assembly allows the access door to be moved from the closed position to the open position, and it engages the anti-rotation catch on the working drum to prevent rotation of the working drum.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout in which.

DESCRIPTION OF THE PREFERRED EMBODIMENTS OF THE INVENTION

Figure 8:
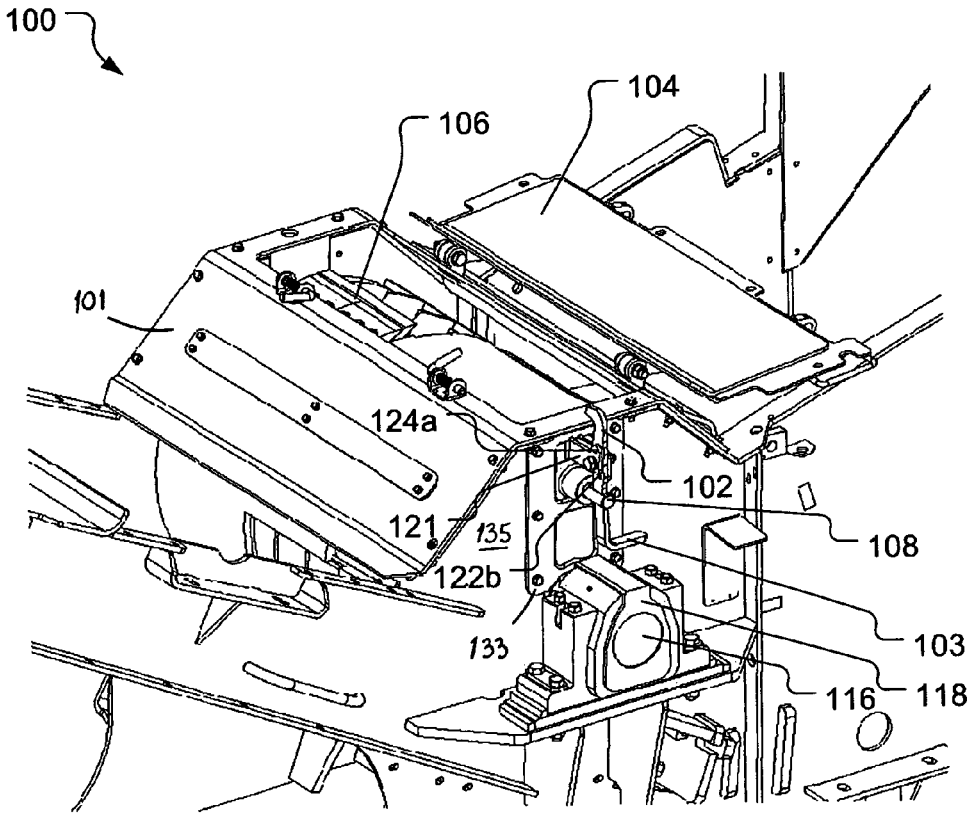
FIG. 8 is a partial perspective view of the drum rotation machine of FIG. 6, showing the access door in the open position.
Figure 9:
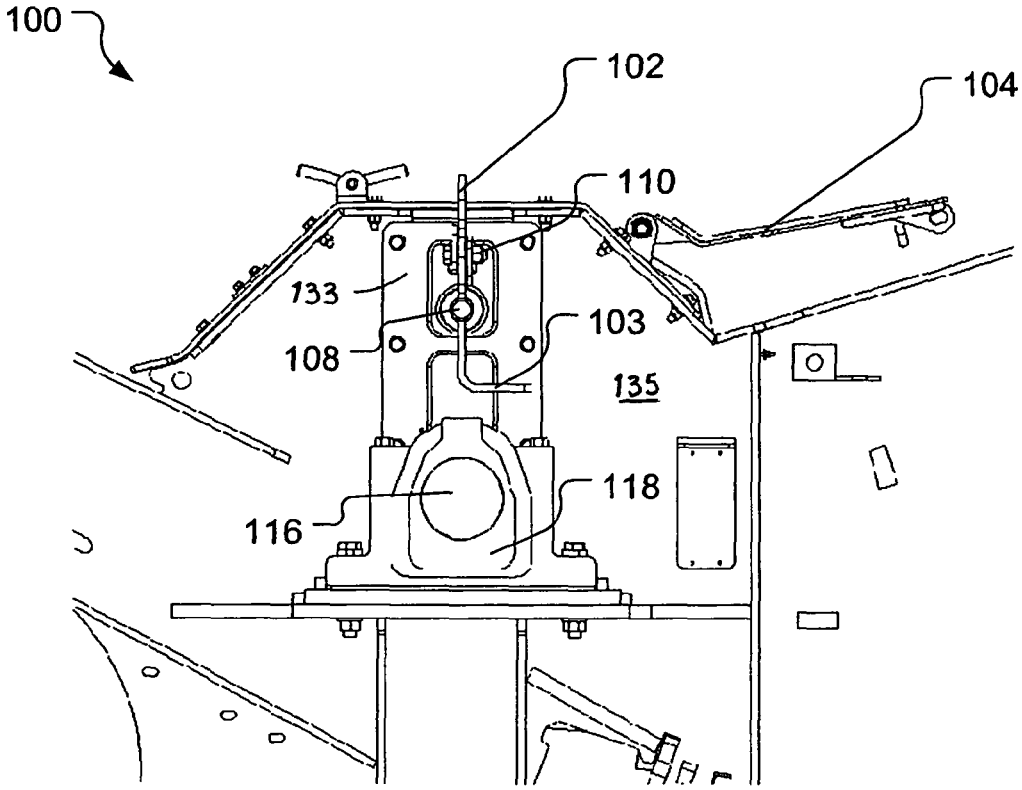
FIG. 9 is a side view of the portion of the drum rotation machine shown in FIG. 8.
Figure 10:
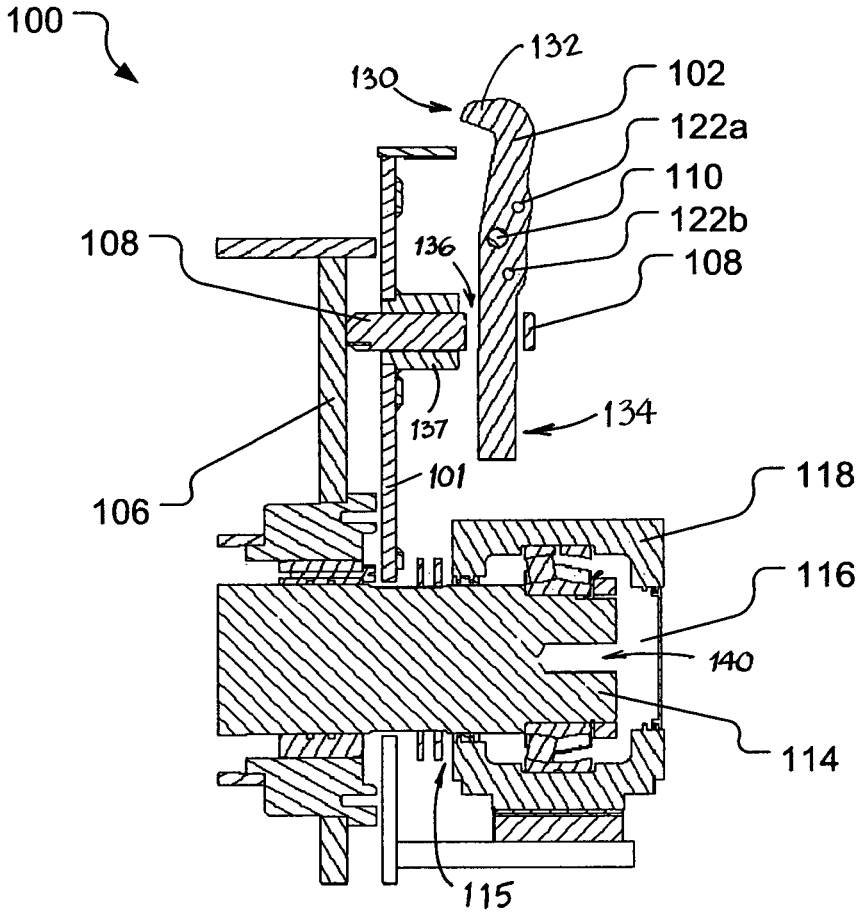
FIG. 10 is a partial sectional view of the latch assembly and a portion of the drum rotation machine of FIG. 8, taken through the plane of the elongate bar of the latch assembly.

The drawings illustrate a drum rotation machine comprising drum-type wood chipper 100 having enclosure 101 and access door 104 that provides access to the interior of the enclosure. Drum-type wood chipper 100 includes many conventional elements known to those having ordinary skill in the art to which the invention relates. Such elements are not described herein or illustrated in the drawings. Access door 104 is moveable between a closed position (illustrated in FIGS. 1-7) and an open position (illustrated in FIGS. 8-10). Working drum 106 (shown in FIGS. 2 and 3) comprises a wood chipper drum that is mounted for rotation about rotation axis 107 within enclosure 101. Working drum 106 has an end 109 on which are mounted a plurality of anti-rotation catches 112. A latch assembly is mounted on the enclosure and is moveable between a locked position (shown in FIGS. 1-5) and an unlocked position (shown in FIGS. 6-10).

The latch assembly includes elongate bar 102 and latch mount 121. Elongate bar 102 has first end 130 which includes blocking component 132 and second end 134 (see FIGS. 5, 7 and 10).

Preferably, second end 134 of elongate bar 102 includes handle portion 103 that allows easy manipulation of the latch assembly. Elongate bar 102 is pivotally mounted about intermediate pivot point 110 on latch mount 121, and latch mount 121 is mounted on bracket 133 on end wall 135 of the enclosure. The latch assembly also includes anti-rotation pin 108 that is adapted to engage one of the anti-rotation catches 112 on the end 109 of working drum 106. Preferably, anti-rotation pin 108 includes slot 136 which is adapted to receive the second end of the elongate bar (see FIGS. 5, 7 and 10). Anti-rotation pin 108 is mounted for axial movement in pin receiver 137 in end wall 135 of enclosure 101, so that pivotal movement of the elongate bar causes anti-rotation pin 108 to move in a direction that is perpendicular to the plane of end wall 135 of enclosure 101, thereby selectively engaging and disengaging anti-rotation pin 108 from one of the anti-rotation catches 112 on working drum 106. Thus, the latch assembly is moveable between the locked position (see FIGS. 1, 2, 3 and 5), in which blocking component 132 abuts the top of access door 104 and prevents the access door from moving from the closed position to the open position, and the unlocked position (see FIGS. 6, 7 and 10), in which blocking component 132 does not prevent access door 104 from moving from the closed position to the open position, and anti-rotation pin 108 engages one of the anti-rotation catches 112 on the working drum to prevent rotation of the working drum. Thus, the latch assembly is configured to make the positions of the access door 104 and the latch assembly, and the rotation of the working drum 106 mechanically conditional, thereby reducing the risk of the access door 104 being opened by an operator when the working drum 106 is moving.

Figure 1:
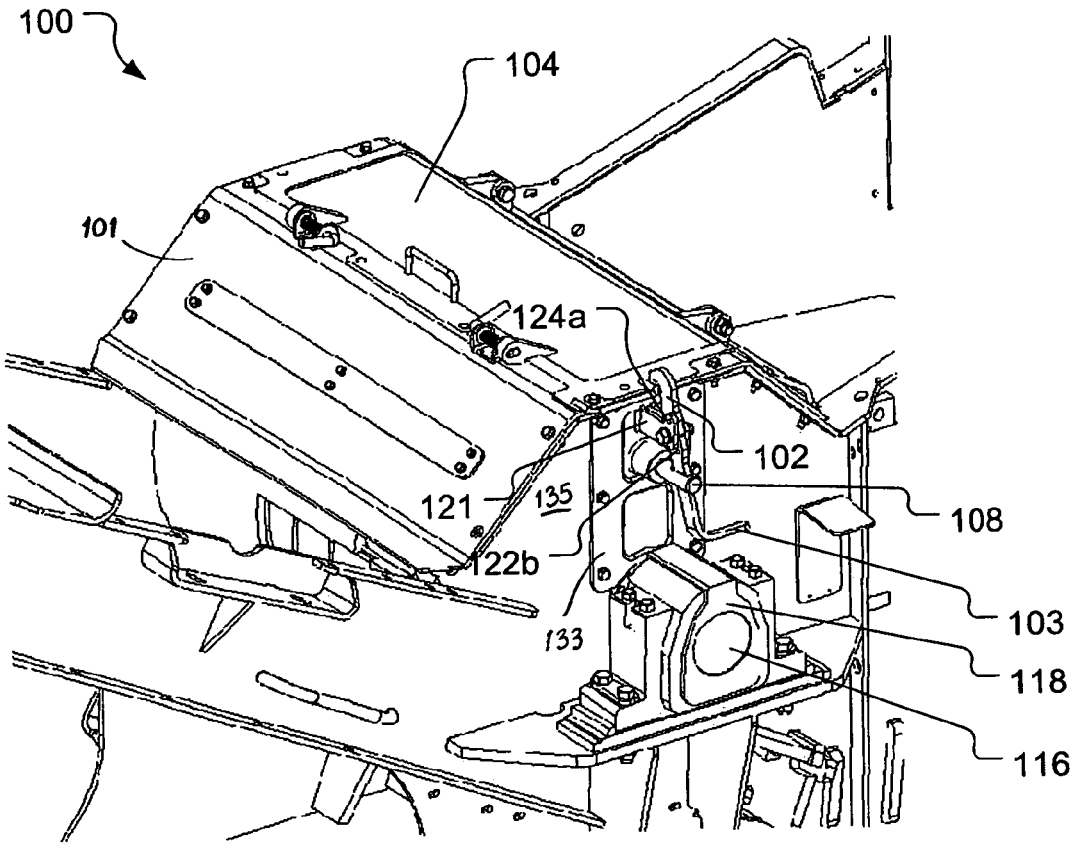
FIG. 1 is a partial perspective view of a drum rotation machine, illustrating the enclosure for a working drum, an access door in the closed position and a latch assembly in the locked position.
Figure 2:
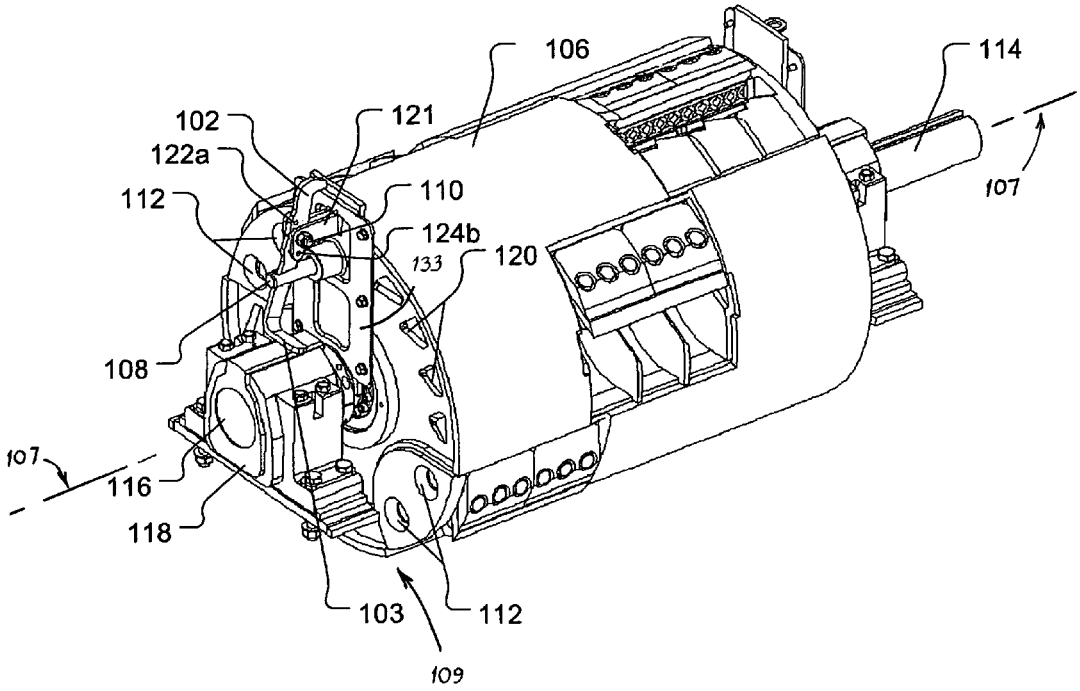
FIG. 2 is a perspective view of the interior structure of the working drum of FIG. 1.
Figure 3:
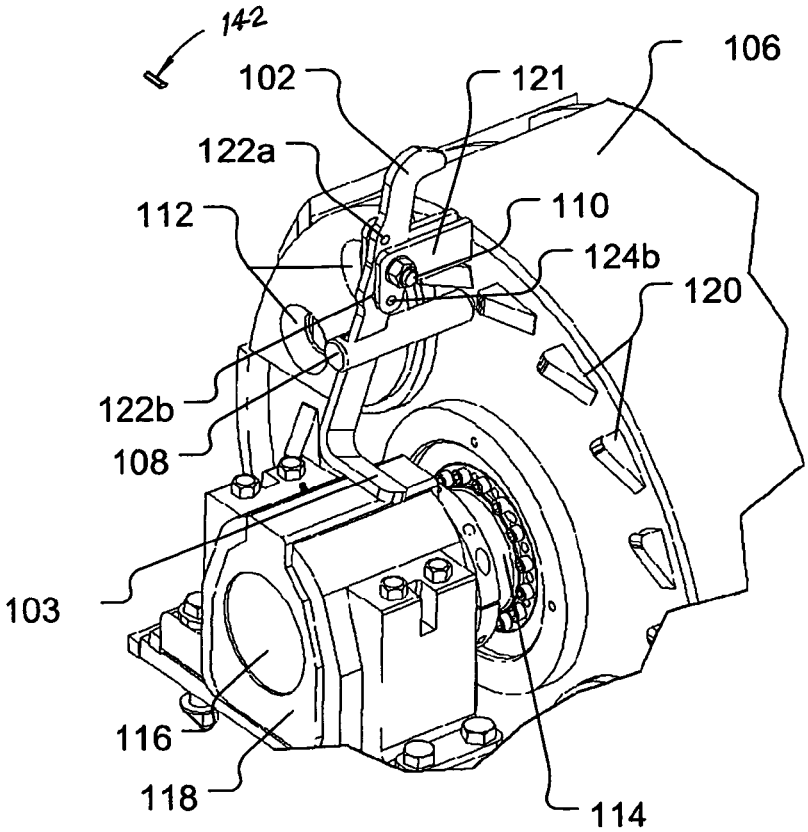
FIG. 3 is an enlarged perspective view of a portion of the interior structure of the working drum of FIG. 2.
Figure 4:
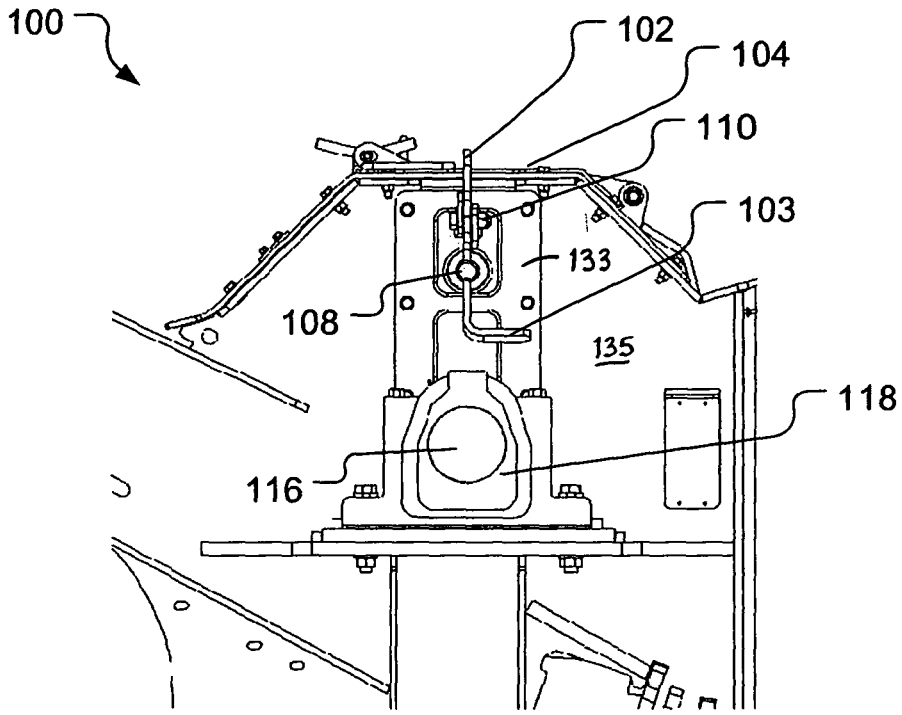
FIG. 4 is a side view of the portion of the drum rotation machine shown in FIG. 1.
Figure 5:
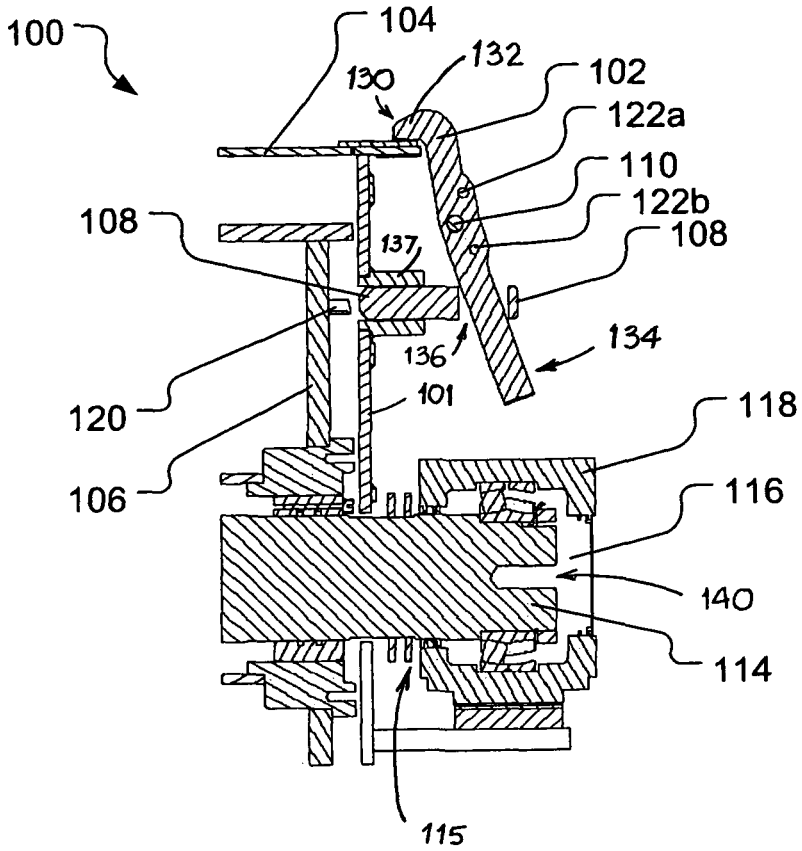
FIG. 5 is a partial sectional view of the latch assembly and a portion of the drum rotation machine of FIG. 1, taken through the plane of the elongate bar of the latch assembly.
Figure 6:
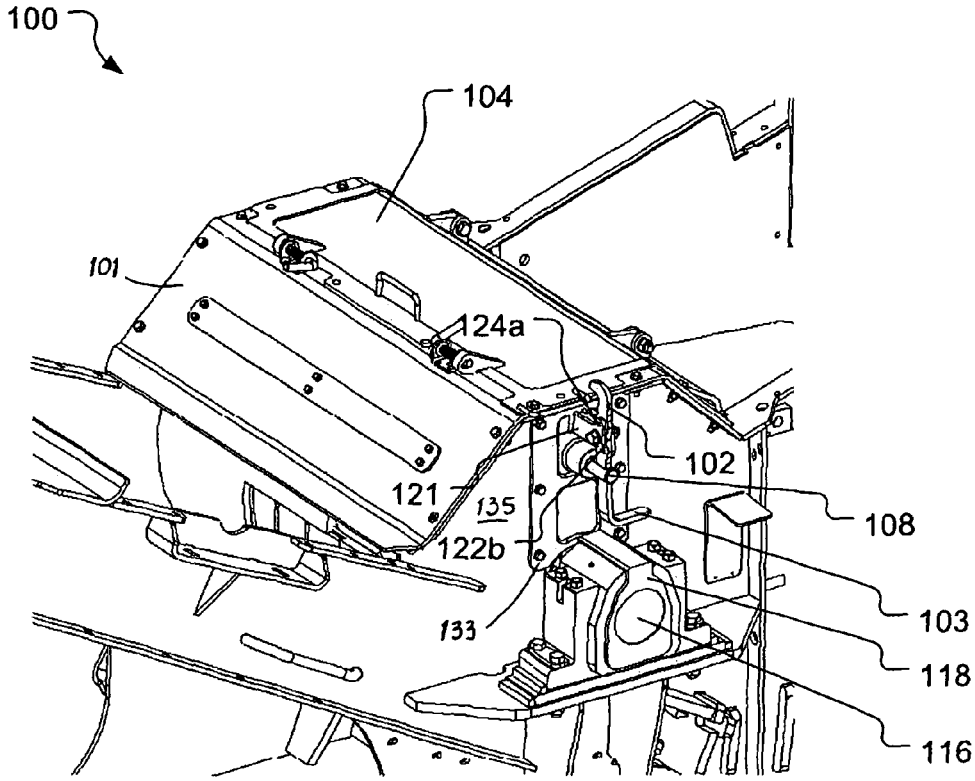
FIG. 6 is a partial perspective view of a drum rotation machine, illustrating the enclosure for a working drum and an access door in the closed position such as is shown in FIG. 1, but with the latch assembly shown in the unlocked position.
Figure 7:
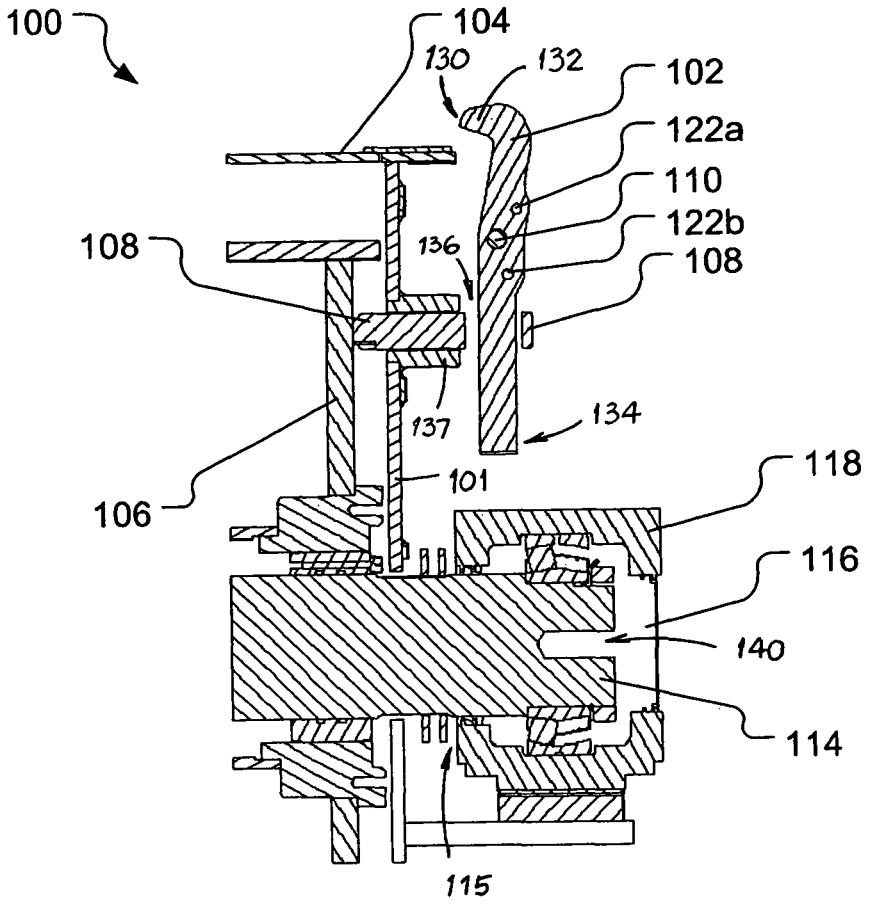
FIG. 7 is a partial sectional view of the latch assembly and a portion of the drum rotation machine of FIG. 6, taken through the plane of the elongate bar of the latch assembly.

As shown in FIG. 2, anti-rotation catches 112 are positioned around the periphery of end 109 of working drum 106 at various locations such that anti-rotation pin 108 may be conveniently engaged into one of the anti-rotation catches 112 without or with little regard for the specific stopping point of the working drum 106. In the illustrated embodiment, there are four anti-rotation catches 112, two located of opposing sides of working drum 106, although working drums and drum-type wood chippers within the scope of the invention may include more or fewer anti-rotation catches 112 in any number of locations on the working drum. Anti-rotation catches 112 may be individually configured to facilitate insertion of the anti-rotation pin 108. As illustrated, for example, preferred anti-rotation catches 112 comprise detents or openings in the surface of the end of the working drum that are provided with beveled edges enabling insertion of the anti-rotation pin. Such anti-rotation catches may provide a degree of tolerance so that it may not be necessary for the anti-rotation pin 108 to be perfectly aligned with one of the anti-rotation catches 112 to permit insertion. The beveled edges may also allow the anti-rotation pin to be inserted into an anti-rotation catch when the working drum 106 is still moving at a slow speed, prior to coming to a full stop.

If working drum 106 comes to a stop such that the anti-rotation pin 108 is between anti-rotation catches 112, thereby preventing engagement of the pin 108 into one of the catches 112, bearing seal ring 114, which comprises a portion of the shaft on which the working drum rotates, may be manually rotated to move the working drum to the desired position. Bearing seal ring 114 is received within bearing housing 118, which has a first open end 115 that is adjacent to end wall 135 of enclosure 101, and second open end 116 that is on the opposite side of the bearing housing. Bearing seal ring 114 includes slot 140 into which a tool (not shown) may be inserted to facilitate unpowered rotation of the shaft.

One or more ramps 120 or similar structures may be provided on the end of the working drum to inhibit forceful engagement of the anti-rotation pin 108 into one of the anti-rotation catches 112 when the working drum is rotating at a high rate of speed. As shown in the drawings, the ramps 120, like the anti-rotation catches 112, are radially aligned (with respect to the working drum) with the anti-rotation pin 108. Consequently, if the working drum has an operational clockwise rotation direction (relative to the illustrated bearing housing 118), an attempt to engage the anti-rotation pin 108 with one of the anti-rotation catches while the working drum is still moving would cause the anti-rotation pin 108 to ride up one of the ramps and into the locked position of the latch assembly, in which the anti-rotation pin is disengaged from any of the anti-rotation catches. Although the drawings show the preferred embodiment including ramps 120 in a squared ramp shape, other configurations may be similarly suitable. For example, rounded bumps or other configurations may also be suitable. In addition, the number of ramps 120 provided may include more or fewer than the number illustrated.

The preferred latch assembly includes structures by which the latch assembly can be fixed against pivotal movement with respect to the latch mount in either the locked position or the unlocked position. Thus, as shown in FIGS. 1-3, 5-8 and 10, latch mount 121 includes first pin hole 124*a* and second pin hole 124*b*. Elongate bar 102 includes locking hole 122*a* and unlocking hole 122*b*. Elongate bar 102 is pivotally mounted on the latch mount so that when the latch assembly is in the locked position, locking hole 122*a* is aligned with first pin hole 124*a* on the latch mount, and so that when the latch assembly is in the unlocked position, unlocking hole 122*b* is aligned with second pin hole 124*b* on latch mount 121. The latch assembly also includes lock pin 142 (see FIG. 3) that is sized and configured to be placed through first pin hole 124*a* on the latch mount and locking hole 122*a* on the elongate bar when the latch assembly is in the locked position. Lock pin 142 is also sized and configured to be placed through second pin hole 124*b* on the latch mount and unlocking hole 122*b* on the elongate bar when the latch assembly is in the unlocked position. When the holes are aligned as desired, pin 142 or a padlock (not shown) can be inserted through the corresponding holes to restrain the elongate bar in either the locked or the unlocked position. Other configurations are contemplated within the scope of the invention. For example, elongate bar 102 may include more or fewer than the illustrated two holes, and the latch mount 121 may similarly include more or fewer than the illustrated two holes. Other locking mechanisms may also be used within the scope of the invention to prevent the latch assembly from shifting from one position to the other at an undesired time.

As described and illustrated herein, the latch assembly is intended to move to the unlocked position only when the working drum has stopped rotating, allowing the blocking component 132 to uncover the edge of access door 104, and anti-rotation pin 108 to engage one of the anti-rotation catches 112. The preferred drum rotation machine may also be configured to stop the engine that drives the working drum if access door 104 is opened when the latch assembly is in the unlocked position by including a door position sensor (not shown) that controls the engine of the machine. Such a door position sensor may be configured so that when access door 104 is opened with the engine running, the engine will stop and a drum brake will engage, thereby stopping rotation of the working drum by the engine. The door position sensor, in cooperation with other electronic components of the drum rotation machine may also prohibit the engine from being restarted unless the access door 104 is closed.

In some embodiments, for instance, the door position sensor may be configured to provide a signal that indicates whether the access door 104 is open or closed. The signal may be used by a logic controller (not illustrated) to operate a relay (not illustrated). The relay may interrupt power to the engine control switch (not illustrated) and stop the engine if the access door 104 is open. The relay may provide power to the engine control switch, enabling starting of the engine and operation of the drum rotation machine only if the access door 104 is closed.

Although this description contains many specifics, these should not be construed as limiting the scope of the invention, but as merely providing illustrations of some of the presently preferred embodiments thereof, as well as the best mode contemplated by the inventor of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A drum rotation machine comprising:

(A) an enclosure;

(B) an access door that provides access to the interior of the enclosure, said access door being moveable between a closed position and an open position;

(C) a working drum mounted for rotation within the enclosure, said working drum having an anti-rotation catch thereon;

(D) a latch assembly that is mounted on the enclosure and is moveable between:

(i) a locked position, in which the latch assembly prevents the access door from moving from the closed position to the open position, and (ii) an unlocked position, in which the latch assembly:

(a) allows the access door to be moved from the closed position to the open position, and (b) engages the anti-rotation catch on the working drum to prevent rotation of the working drum.

2. The drum rotation machine of claim 1:

(A) wherein the enclosure includes a latch mount, said latch mount including a first pin hole and a second pin hole;

(B) wherein the latch assembly comprises an elongate bar which:

(i) includes a locking hole (ii) includes an unlocking hole;

(iii) is pivotally mounted on the latch mount:

(a) so that when the latch assembly is in the locked position, the locking hole is aligned with the first pin hole on the latch mount; and (b) so that when the latch assembly is in the unlocked position, the unlocking hole is aligned with the second pin hole on the latch mount;

(C) which includes a lock pin:

(i) that is sized and configured to be placed through the first pin hole on the latch mount and the locking hole on the elongate bar when the latch assembly is in the locked position;

(ii) that is sized and configured to be placed through the second pin hole on the latch mount and the unlocking hole on the elongate bar when the latch assembly is in the unlocked position.

3. The drum rotation machine of claim 1:

(A) wherein the enclosure includes an end wall that is perpendicular to the axis of rotation of the working drum;

(B) which includes a bearing housing including:

(i) a first open end that is adjacent to the end wall of the enclosure;

(ii) a second open end that is on the opposite side of the bearing housing from the first open end;

(C) wherein the working drum comprises a wood chipper drum that is mounted on a shaft which includes a bearing seal ring, which bearing seal ring:

(i) extends through the first open end of the bearing housing and into the bearing housing;

(ii) includes a slot that may be engaged by a tool to rotate the shaft.

4. The drum rotation machine of claim 1 wherein:

(A) the enclosure includes an end wall that is perpendicular to the axis of rotation of the working drum;

(B) the anti-rotation catch is mounted on an end of the working drum;

(C) the latch assembly:

(i) includes an elongate bar that is pivotally mounted on the end wall of the enclosure for movement between the locked position and the unlocked position, said elongate bar including a blocking component that prevents the access door from moving from the closed position to the open position when the latch assembly is in the locked position;

(iii) includes an anti-rotation pin that engages the anti-rotation catch on the end of the working drum when the latch assembly is in the unlocked position and the working drum is not rotating.

5. The drum rotation machine of claim 4 which includes a ramp mounted on the end of the working drum adjacent to the anti-rotation catch and radially aligned with the anti-rotation pin, so that if the latch assembly is moved to the unlocked position while the working drum is rotating, the ramp is configured and arranged to prevent the anti-rotation pin from engaging the anti-rotation catch.

6. The drum rotation machine of claim 4 which includes a plurality of anti-rotation catches spaced around the periphery of the end of the working drum.

7. The drum rotation machine of claim 6 which includes a ramp mounted on the end of the working drum adjacent to each of the anti-rotation catches and radially aligned with the anti-rotation pin, so that if the latch assembly is moved to the unlocked position while the working drum is rotating, each of the ramps is configured and arranged to prevent the anti-rotation pin from engaging its adjacent anti-rotation catch.

8. The drum rotation machine of claim 4 wherein:

(A) the anti-rotation pin includes a slot;

(B) the elongate bar includes:

(i) a first end which includes the blocking component;

(ii) a second end opposite the first end, which second end is disposed within the slot of the anti-rotation pin; and (iii) an intermediate pivot point located between the first end and the second end.

9. The drum rotation machine of claim 8 wherein the second end of the elongate bar includes a handle portion.

10. A drum rotation machine comprising:

(A) an enclosure having an end wall;

(B) an access door that provides access to the interior of the enclosure, said access door being moveable between a closed position and an open position;

(C) a working drum mounted for rotation within the enclosure along an axis of rotation that is perpendicular to the end wall of the enclosure, said working drum having an end with an anti-rotation catch thereon;

(D) a latch assembly that is mounted on the enclosure, said latch assembly:

(i) including an elongate bar that is pivotally mounted on the end wall of the enclosure, said elongate bar including a blocking component;

(ii) including an anti-rotation pin that is adapted to engage the anti-rotation catch on the end of the working drum;

(iii) being moveable between a locked position, in which the blocking component prevents the access door from moving from the closed position to the open position, and an unlocked position, in which:

(a) the blocking component does not prevent the access door from moving from the closed position to the open position, and (b) the anti-rotation pin engages the anti-rotation catch on the working drum to prevent rotation of the working drum.

11. The drum rotation machine of claim 10 which includes a ramp mounted on the end of the working drum adjacent to the anti-rotation catch and radially aligned with the anti-rotation pin, so that if the latch assembly is moved to the unlocked position while the working drum is rotating, the ramp is configured and arranged to prevent the anti-rotation pin from engaging the anti-rotation catch.

12. The drum rotation machine of claim 10 which includes a plurality of anti-rotation catches spaced around the periphery of the end of the working drum.

13. The drum rotation machine of claim 12 which includes a ramp mounted on the end of the working drum adjacent to each of the anti-rotation catches and radially aligned with the anti-rotation pin, so that if the latch assembly is moved to the unlocked position while the working drum is rotating, each of the ramps is configured and arranged to prevent the anti-rotation pin from engaging its adjacent anti-rotation catch.

14. The drum rotation machine of claim 10 wherein:

(A) the anti-rotation pin includes a slot;

(B) the elongate bar includes:

(i) a first end which includes the blocking component;

(ii) a second end opposite the first end, which second end is disposed within the slot of the anti-rotation pin; and (iii) an intermediate pivot point located between the first end and the second end.

15. The drum rotation machine of claim 10:

(A) which includes a bearing housing including:

(i) a first open end that is adjacent to the end wall of the enclosure;

(ii) a second open end that is on the opposite side of the bearing housing from the first open end;

(B) wherein the working drum comprises a wood chipper drum that is mounted on a shaft which includes a bearing seal ring, which bearing seal ring:

(i) extends through the first open end of the bearing housing and into the bearing housing;

(ii) includes a slot that may be engaged by a tool to rotate the shaft.

* * * * *